US009835021B2

(12) United States Patent
Samuel et al.

(10) Patent No.: US 9,835,021 B2
(45) Date of Patent: Dec. 5, 2017

(54) RATIO-BASED MODE SWITCHING FOR OPTIMIZING WEIGHT-ON-BIT

(71) Applicant: LANDMARK GRAPHICS CORPORATION, Houston, TX (US)

(72) Inventors: Robello Samuel, Cypress, TX (US); Aniket, Houston, TX (US); Gustavo A. Urdaneta, Houston, TX (US)

(73) Assignee: LANDMARK GRAPHICS CORPORATION, Houston, TX (US)

( * ) Notice: Subject to any disclaimer, the term of this patent is extended or adjusted under 35 U.S.C. 154(b) by 0 days.

(21) Appl. No.: 15/028,625

(22) PCT Filed: Oct. 28, 2013

(86) PCT No.: PCT/US2013/067030
§ 371 (c)(1),
(2) Date: Apr. 11, 2016

(87) PCT Pub. No.: WO2015/065311
PCT Pub. Date: May 7, 2015

(65) Prior Publication Data

US 2016/0251953 A1 Sep. 1, 2016

(51) Int. Cl.
*E21B 44/02* (2006.01)
*E21B 47/024* (2006.01)
(Continued)

(52) U.S. Cl.
CPC ..... *E21B 44/02* (2013.01); *E21B 21/08* (2013.01); *E21B 41/0092* (2013.01);
(Continued)

(58) Field of Classification Search
CPC ..... E21B 44/02; E21B 21/08; E21B 41/0092; E21B 44/04; E21B 45/00; E21B 47/024; E21B 47/08; E21B 47/12
(Continued)

(56) References Cited

U.S. PATENT DOCUMENTS 4,384,483 A 5/1983 Dellinger et al.
6,443,242 B1 9/2002 Newman et al.
(Continued)

FOREIGN PATENT DOCUMENTS

WO 2013/148262 10/2013
WO 2015/065311 5/2015

OTHER PUBLICATIONS

H. Hishida et al. Prediction of Helical / Sinusoidal Buckling, IADC/SPE, 1996, IADC/SPE Pacific Drilling Technology Conference, IADC/SPE 36384.*
(Continued)

*Primary Examiner* — Mohammad Ali
*Assistant Examiner* — Joshua Sanders
(74) *Attorney, Agent, or Firm* — Gilliam IP PLLC

(57) ABSTRACT

Drilling system and methods may employ a weight-on-bit optimization for an existing drilling mode and, upon transitioning to a different drilling mode, determine an initial weight-on-bit within a range derived from: a sinusoidal buckling ratio, a helical buckling ratio, and the weight-on-bit value for the prior drilling mode. The sinusoidal buckling ratio is the ratio of a minimum weight-on-bit to induce sinusoidal buckling in a sliding mode to a minimum weight-on-bit to induce sinusoidal buckling in a rotating mode, and the helical buckling ratio is the ratio of a minimum weight-on-bit to induce helical buckling in the sliding mode to a minimum weight-on-bit to induce helical buckling in the rotating mode. The ratios are a function of the length of the drill string and hence vary with the position of the drill bit along the borehole.

20 Claims, 3 Drawing Sheets

(51) Int. Cl.

| | |
|---|---|
| ***E21B 47/08*** | (2012.01) |
| ***E21B 44/04*** | (2006.01) |
| ***E21B 47/16*** | (2006.01) |
| ***E21B 47/12*** | (2012.01) |
| ***E21B 47/18*** | (2012.01) |
| ***E21B 45/00*** | (2006.01) |
| ***E21B 41/00*** | (2006.01) |
| ***E21B 21/08*** | (2006.01) |

(52) U.S. Cl.
CPC ..... *E21B 44/04* (2013.01); *E21B 45/00* (2013.01); *E21B 47/024* (2013.01); *E21B 47/08* (2013.01); *E21B 47/12* (2013.01); *E21B 47/16* (2013.01); *E21B 47/18* (2013.01)

(58) Field of Classification Search
USPC ..... 700/160
See application file for complete search history.

(56) References Cited

U.S. PATENT DOCUMENTS

| | | | | |
|---|---|---|---|---|
| 2005/0284661 | A1 | 12/2005 | Goldman et al. | |
| 2006/0065440 | A1 | 3/2006 | Hutchinson | |
| 2011/0186353 | A1* | 8/2011 | Turner | G05B 13/048 175/40 |
| 2014/0360787 | A1* | 12/2014 | Williams | E21B 7/067 175/73 |

OTHER PUBLICATIONS

Joseph Ray, M.D., Ray'S Algebra, Part First, 1848, Wilson, Hinkle & Co., Revised Edition, p. 232.*

PCT International Search Report and Written Opinion, dated Jul. 18, 2014, Appl No. PCT/US2013/067030, "Ratio-Based Mode Switching for Optimizing Weight-on-Bit," Filed Oct. 28, 2013, 14 pgs.

* cited by examiner

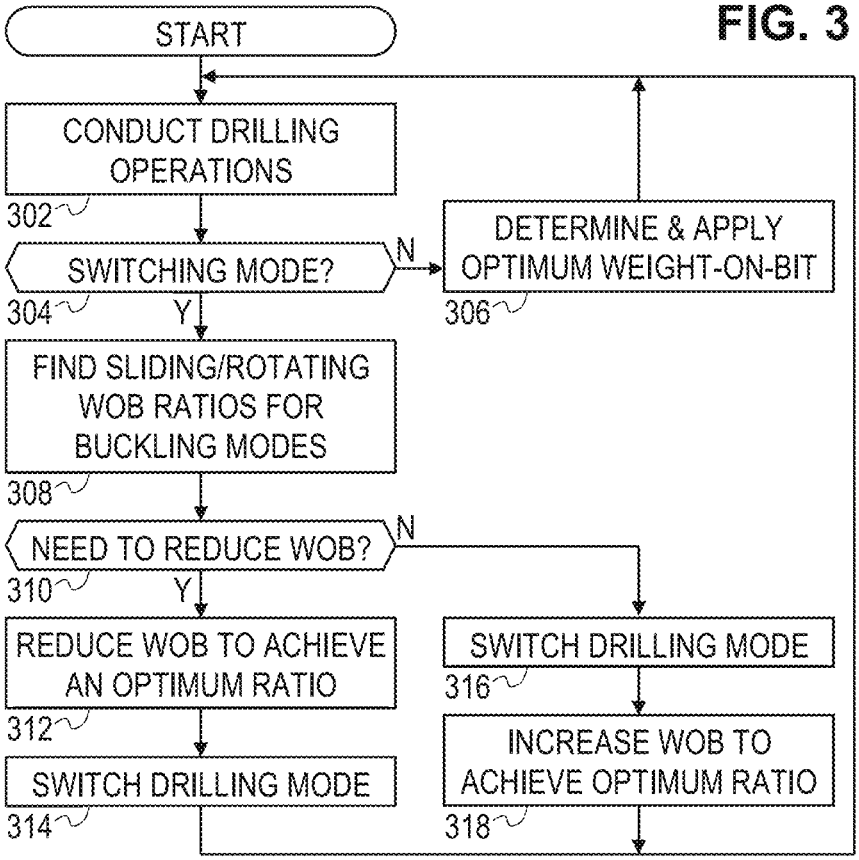
FIG. 3
START
CONDUCT DRILLING OPERATIONS
302
SWITCHING MODE?
304
N
Y
DETERMINE & APPLY OPTIMUM WEIGHT-ON-BIT
306
FIND SLIDING/ROTATING WOB RATIOS FOR BUCKLING MODES
308
NEED TO REDUCE WOB?
310
N
Y
REDUCE WOB TO ACHIEVE AN OPTIMUM RATIO
312
SWITCH DRILLING MODE
314
SWITCH DRILLING MODE
316
INCREASE WOB TO ACHIEVE OPTIMUM RATIO
318

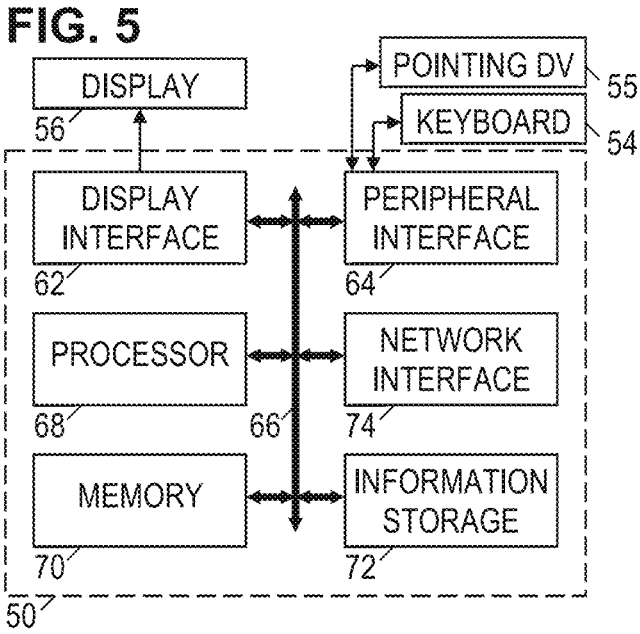
FIG. 5
DISPLAY
56
POINTING DV
55
KEYBOARD
54
DISPLAY INTERFACE
62
PERIPHERAL INTERFACE
64
PROCESSOR
68
66
NETWORK INTERFACE
74
MEMORY
70
INFORMATION STORAGE
72
50

RATIO-BASED MODE SWITCHING FOR OPTIMIZING WEIGHT-ON-BIT

BACKGROUND

Modern drilling operations have become marvels of technology and engineering science. The industry's efforts to maximize profitability range from initiatives that minimize "non-productive time" of drilling rigs and crews and maximize rates of penetration during the drilling process, to development of new methods for maximizing reservoir drainage and production rates. It is now commonplace for drilling crews to steer their drill strings along pre-planned or adaptively chosen borehole trajectories selected for optimum placement.

To the extent that crews can maximize the rate of penetration (without incurring additional non-productive time), they can complete their boreholes faster and, consequently, complete more boreholes within a given budget. One of the major factors for rate of penetration (though by no means the only factor) is weight-on-bit. Weight-on-bit is a measure of the amount of force that a drill string exerts on the bit face. It is a function of the configuration of the bottom hole assembly (including the size and number of heavily-weighted rigid drill collars), the weight and rigidity of the drill string itself, the hook load (the lifting force on the upper end of the drill string), the borehole size and trajectory, and a number of dynamic factors including frictional forces. As explained further below, these dynamic factors are affected by the drilling mode.

Rate of penetration is not a monotonic function of weight-on-bit. There is a "sweet spot" beyond which increasing the weight-on-bit actually reduces rate of penetration and eventually causes premature wear and damage to the bit. Similarly, weight-on-bit is not a monotonic function of hook load. As the hook load is reduced the drill string initially transfers its weight to the bottom hole assembly, thereby increasing the weight on bit. As the hook load is further reduced, however, the axial load along the drill string causes the drill string to bend, increasing the friction between the drill string and the wall. Further axial loads cause the drill string to buckle and eventually to reach a state referred to as "lock up", where the frictional forces prevent any further progress along the borehole.

The complexity of this problem has led to the development of many methods and techniques for optimizing the rate of penetration. However, this complexity is magnified during the steering process. In particular, crews often have to transition between drilling modes as part of the steering process. For example, when maintaining the present course of the drill bit, crews employing bent-sub steering technology must operate in a "rotating mode" where the drill string rotates. To deviate from the present course, the crew transitions to a "sliding mode" where the rotation of the drill string is halted. (The drill bit continues to rotate due to the presence of a downhole motor.) Frequent transitions back and forth between the two modes are often required. Unfortunately, the different modes have different weight transfer characteristics due to different frictional forces and different buckling thresholds. Existing methods and techniques do not appear to adequately account for these differences, so crews have had to unduly limit their rate of penetration during the steering process.

BRIEF DESCRIPTION OF THE DRAWINGS

Accordingly, there are disclosed in the drawings and the following description various drilling systems and methods having ratio-based mode switching for optimizing weight-on-bit.

In the drawings:

FIG. 3 is a flow diagram of an illustrative drilling method.

FIG. 5 is a block diagram of an illustrative computer suitable for executing the method.

Figure 1:
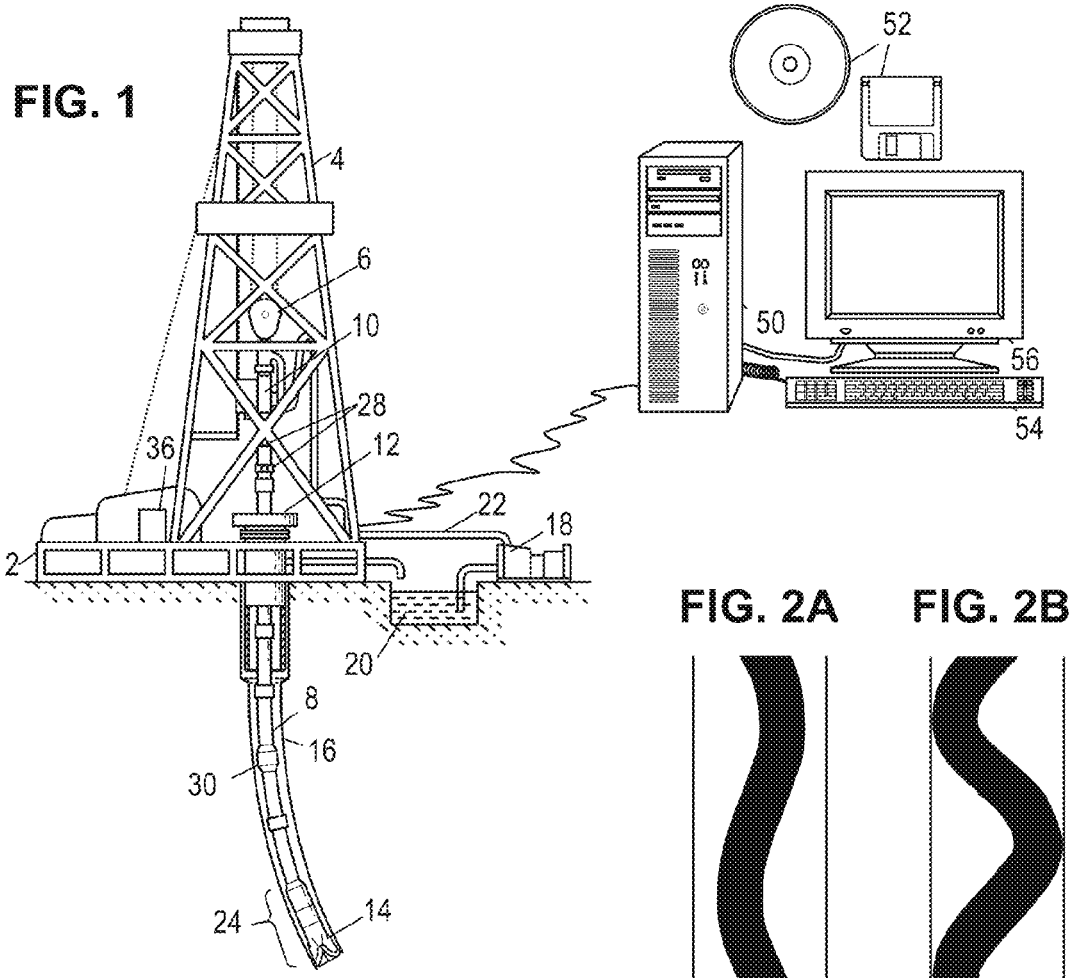
FIG. 1 shows an illustrative drilling system.

It should be understood, however, that the specific embodiments given in the drawings and detailed description thereto do not limit the disclosure. On the contrary, they provide the foundation for one of ordinary skill to discern the alternative forms, equivalents, and modifications that are encompassed together with one or more of the given embodiments in the scope of the appended claims.

DETAILED DESCRIPTION

Certain disclosed system and method embodiments employ rate of penetration optimization for an existing drilling mode and, upon transitioning to a different drilling mode, determine a corresponding weight-on-bit range based upon: a sinusoidal buckling ratio, a helical buckling ratio, and a weight-on-bit value for the prior drilling mode. The sinusoidal buckling ratio is the ratio of a minimum weight-on-bit to induce sinusoidal buckling in a sliding mode to a minimum weight-on-bit to induce sinusoidal buckling in a rotating mode, and the helical buckling ratio is the ratio of a minimum weight-on-bit to induce helical buckling in the sliding mode to a minimum weight-on-bit to induce helical buckling in the rotating mode. The ratios are a function of the length of the drill string and hence vary with the position of the drill bit along the borehole. Other factors include the configuration of the drill string (weight, rigidity, diameter, frictional coefficient), borehole size, and borehole trajectory.

The weight-on-bit for the current drilling mode is transitioned into the specified range (or equivalently, the ratio between the current weight-on-bit and prior weight-on-bit is transitioned into the range between the sinusoidal and helical buckling ratios) before initiating any further optimization of the rate of penetration. In this manner, the transition between sliding and rotating modes can be performed repeatedly and as often as needed without increasing buckling and lock up risks, and without unduly impairing rate of penetration during the steering process.

FIG. 1 shows an illustrative drilling system having a drilling platform 2 with a derrick 4 having a traveling block 6 for raising and lowering a drill string 8. A top drive 10 supports and optionally rotates the drill string 8 as it is lowered through the wellhead 12. A drill bit 14 is driven by a downhole motor and/or rotation of the drill string 8. As bit 14 rotates, it creates a borehole 16 that passes through various formations. A pump 18 circulates drilling fluid 20 through a feed pipe 22, through the interior of the drill string 8 to drill bit 14. The fluid exits through orifices in the drill bit 14 and flows upward through the annulus around the drill string 8 to transport drill cuttings to the surface, where the fluid is filtered and recirculated.

The drill bit 14 is just one piece of a bottom-hole assembly 24 that includes the downhole motor and one or more "drill collars" (thick-walled steel pipe) that provide weight and rigidity to aid the drilling process. Often, some of these drill collars include built-in logging instruments to gather measurements of various drilling parameters such as position, orientation, weight-on-bit, borehole diameter, etc. The tool orientation may be specified in terms of a tool face angle (rotational orientation), an inclination angle (the slope), and compass direction, each of which can be derived from measurements by magnetometers, inclinometers, and/or accelerometers, though other sensor types such as gyroscopes may alternatively be used. In one specific embodiment, the tool includes a 3-axis fluxgate magnetometer and a 3-axis accelerometer. As is known in the art, the combination of those two sensor systems enables the measurement of the tool face angle, inclination angle, and compass direction. Such orientation measurements can be combined with gyroscopic or inertial measurements to accurately track tool position.

Also included in bottom hole assembly 24 is a telemetry sub that maintains a communications link with the surface. Mud pulse telemetry is one common telemetry technique for transferring tool measurements to surface receivers and receiving commands from the surface, but other telemetry techniques can also be used. For some techniques (e.g., through-wall acoustic signaling) the drill string 8 includes one or more repeaters 30 to detect, amplify, and re-transmit the signal. At the surface, transducers 28 convert signals between mechanical and electrical form, enabling a network interface module 36 to receive the uplink signal from the telemetry sub and (at least in some embodiments) transmit a downlink signal to the telemetry sub. A data processing system 50 receives a digital telemetry signal, demodulates the signal, and displays the tool data or well logs to a user. Software (represented in FIG. 1 as information storage media 52) governs the operation of system 50. A user interacts with system 50 and its software 52 via one or more input devices 54 and one or more output devices 56. In some system embodiments, a driller employs the system to make geosteering decisions and communicate appropriate commands to the bottom hole assembly 24.

Based on the output of the data processing system, the driller can further adjust the operation of the traveling block 6 as needed to regulate the hook load and weight-on-bit. Some advanced rig configurations enable the data processing system to perform this operation automatically to maximize rate of penetration subject to various constraints. For example, certain weight-on-bit constraints may be imposed by the data processing system 50 to prevent damage to the bit or the rig, to ensure adequate flushing of cuttings from the borehole, to assure adequate response times in underbalanced drilling or other circumstances presenting danger of a blowout, and avoiding lock-up in any form including helical buckling.

Figure 2A:
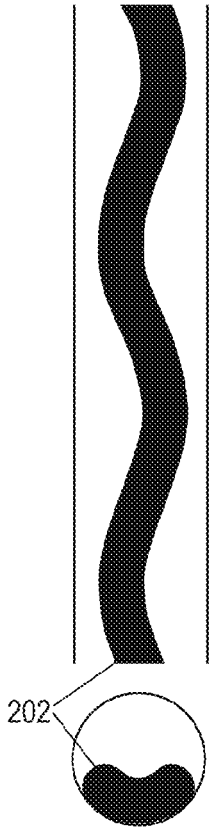
FIGS. 2A-2B show illustrative drill string buckling modes.
Figure 2B:
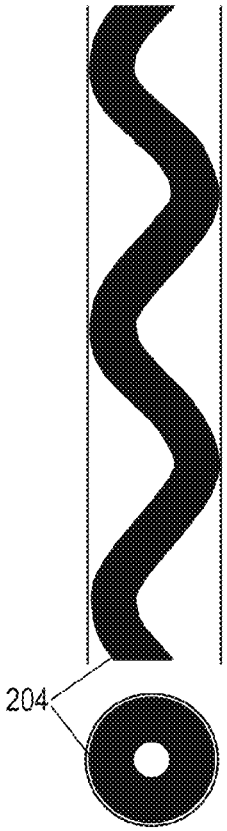

As mentioned previously, the drill string experiences buckling under elevated axial loading. FIG. 2A illustrates a first type of buckling generally termed "sinusoidal buckling". Assuming a horizontal borehole, the drill string 202 rests along the bottom side of the borehole as shown in the end view, but as can be seen from the top view, the drill string has assumed a wave shape similar to a sinusoid. The frictional forces and force transfer in this mildly buckled state (the wave periodicity is exaggerated in the figures for illustrative purposes) are not much different from those of a straight drill string, so this initial buckling state is often considered an acceptable operating condition. However as the axial load increases, the wave amplitude increases and the period decreases until the buckling mode transitions to the "helical buckling" mode illustrated in FIG. 2B. Like a corkscrew, the drill string 204 assumes the shape of a helix and exerts a large force on the borehole walls. The frictional forces become dominant, inhibiting any force transfer to the bottom hole assembly. This buckling state is known to be highly inefficient, to have an elevated risk of damage to the drill string, and is generally considered to be an unacceptable operating condition. The operating condition that provides the maximum weight-on-bit can generally be found in the range between these two states.

FIG. 3 shows an illustrative drilling method that employs ratio-based mode switching. It can be implemented in a variety of ways including as software in data processing system 50. Beginning with block 302, the system monitors ongoing drilling operations, collecting measurements indicative of, among other things, weight-on-bit, hook load, torque, rotations-per-minute of the drill string, and borehole trajectory. The combination of these measurements can be employed to derive an operating state of the drill string and to estimate thresholds such as the minimum weight-on-bit at which sinusoidal buckling might occur and the minimum weight-on-bit at which helical buckling might occur. Models for these calculations can be found in the literature. See, for example, He and Kyllingstad, "Helical Buckling and Lock-Up Conditions for Coiled Tubing in Curved Wells", SPE Drilling & Completion, p 10-15, March 1995. These calculations can also be performed with commercially available software such as, e.g., Decision Space Well Engineering (DSWE) package available from Halliburton.

In block 304, the system checks for a desired change of drilling mode, e.g., from rotating to sliding mode or vice-versa. In the absence of a transition, the system estimates and displays an optimum weight-on-bit value in block 306, and returns to block 302. Otherwise, if a transition is being initiated from a prior mode to a current mode, in block 308 the system finds sinusoidal and helical buckling ratios for the current position of the drill bit. The sinusoidal buckling ratio is the ratio of a minimum weight-on-bit to induce sinusoidal buckling in a sliding mode to a minimum weight-on-bit to induce sinusoidal buckling in a rotating mode, and the helical buckling ratio is the ratio of a minimum weight-on-bit to induce helical buckling in the sliding mode to a minimum weight-on-bit to induce helical buckling in the rotating mode. These weight-on-bit and ratio values depend on a number of factors including drill string weight per unit length, drill string rigidity, and local trajectory of the borehole.

Figure 4:
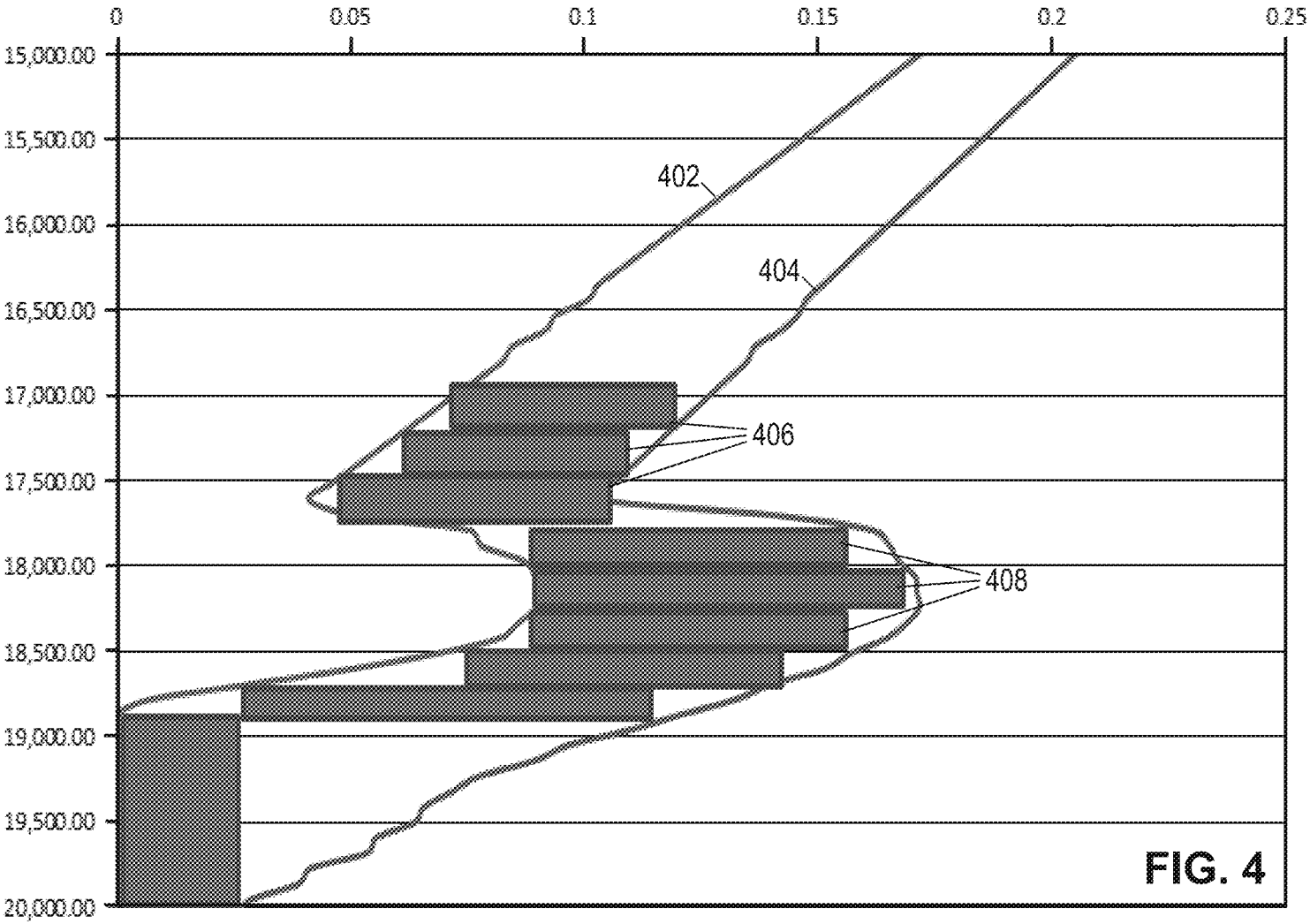
FIG. 4 is a graph of sinusoidal and helical buckling mode ratios as a function of position.

Turning momentarily to FIG. 4, illustrative ratios are shown as a function of drill string length (in feet). Curve 402 shows the sinusoidal buckling ratio, while curve 404 shows the helical buckling ratio. The sinusoidal buckling ratio declines from around 0.154 at 15,000 ft to zero around 18,900 ft. The helical buckling ratio declines from about 0.21 at 15,000 ft to about 0.025 at 20,000 ft. The curves are not monotonic, as a borehole deviation around 17,600 ft temporarily increases both ratios. The curves are used to specify desirable operating windows 406, 408 that, in the illustrated example, are fixed for 200 ft lengths of the borehole. Note in particular that during the steering process the desirable operating windows 408 exhibit a marked increase, enabling more aggressive drilling rates than have been attempted in the past. At least some embodiments of data processing system 50 may provide a drilling window visualization to the user using a graph similar to that of FIG. 4.

Returning to FIG. 3, the system determines in block 310 whether the drilling mode transition necessitates a weight-on-bit reduction. For transitions where the weight-on-bit will be reduced, such reduction should be performed before the transition to avoid exceeding the reduced helical buckling threshold. Some of this reduction may come from the increased friction experienced by the drill string as it transitions from the prior mode to the current mode, but the hook load may also need to be adjusted. The adjustments should be timed to avoid imposing too much axial load when the current drilling mode has been achieved. Accordingly, for weight-on-bit reductions, the system performs the necessary weight-on-bit adjustment in block 312 before transitioning to the current mode in block 314. The initial weight-on-bit for the current drilling mode should fall within the appropriate desired operating windows, which in the disclosed embodiments are defined in terms of the sinusoidal buckling ratio and the helical buckling ratio.

In some implementations of block 312, the optimum weight-on-bit for the prior mode (as determined during ongoing operations in block 306), is combined with the buckling ratios to determine the weight-on-bit limits of the desirable operating window. The initial weight-on-bit for the current mode is then adjusted as needed to operate within this window. Thereafter, the system may return to block 302 and employ the usual optimization strategies for refining the weight-on-bit value for the current drilling mode.

In other implementations, the system determines the expected weight-on-bit value from the transition to the current mode and calculates a ratio of this value to the optimum weight-on-bit value for the prior mode (as previously determined in block 306). (This expected value may be the result of the change in frictional forces attributable to the transition to sliding mode.) This weight-on-bit ratio is compared to the sinusoidal and helical buckling ratios to determine whether the system will be operating within the desired window. If needed, the initial weight-on-bit for the current mode is adjusted to place the weight-on-bit ratio inside the window, possibly by varying the hook load. Thereafter, the system may return to block 302 and employ the usual optimization strategies for refining the weight-on-bit value for the current operation.

For the transitions where an increase in weight-on-bit is desirable, the transition to the current mode should be initiated before the weight-on-bit is increased to avoid exerting an excess axial load in the prior mode. Some of the increase may come from the reduced friction experienced by the drill string in the current mode, but the hook load may also need to be adjusted. Such adjustments should be timed to avoid imposing too much axial load before the current mode has started. Accordingly, the system initiates the switch from the prior mode to the current mode in block 316 before performing the necessary weight-on-bit adjustments in block 318. As before, the desired operating window for the initial weight-on-bit for the rotating mode is defined based on the prior weight-on-bit and the sinusoidal and helical buckling ratios. As with the previous implementations, the window may be expressed with the ratios themselves and compared to a ratio of the expected weight-on-bit value to the prior weight-on-bit value, or alternatively expressed as weight-on-bit values determined from combining the prior weight-on-bit value with the buckling ratios. After setting the initial weight-on-bit for the rotating mode, the system returns to block 302.

FIG. 5, is a block diagram of an illustrative data processing system suitable for collecting, processing, and displaying data associated with weight-on-bit and other operating conditions of a drill string. In some embodiments, the system generates control signals from the measurements and displays them to a user. In some embodiments, a user may further interact with the system to send commands to the rig and winch assembly to adjust its operation in response to the received data, including weight-on-bit adjustments and transitions between rotating and sliding modes. If desired, the system can be programmed to send such commands automatically in response to the measurements, thereby enabling the system to serve as an autopilot for the drilling process.

The system of FIG. 5 can take the form of a desktop computer that includes a chassis 50, a display 56, and one or more input devices 54, 55. Located in the chassis 50 is a display interface 62, a peripheral interface 64, a bus 66, a processor 68, a memory 70, an information storage device 72, and a network interface 74. Bus 66 interconnects the various elements of the computer and transports their communications. The network interface 74 couples the system to telemetry transducers that enable the system to communicate with the rig equipment and the bottom hole assembly. In accordance with user input received via peripheral interface 54 and program instructions from memory 70 and/or information storage device 72, the processor processes the measurement information received via network interface 74 to construct operating logs and control signals and display them to the user.

The processor 68, and hence the system as a whole, generally operates in accordance with one or more programs stored on an information storage medium (e.g., in information storage device 72). One or more of these programs configures the processing system to carry out at least one of the drilling methods disclosed herein.

Numerous variations and modifications will become apparent to those skilled in the art once the above disclosure is fully appreciated. As one example, the ratios defined herein are usually expressed with the numerator relating to a sliding mode value and the denominator relating to the rotating mode, but the inverse ratios could be used in a largely equivalent manner. As another example, those drilling configurations that lack any measurement of actual weight-on-bit may employ instead a weight-on-bit value derived from a model or predictive simulation.

It is intended that the following claims be interpreted to embrace all such variations and modifications.

What is claimed is:

1. A drilling method that comprises:

operating a drill string drilling operation in a first drilling mode that applies a first weight-on-bit;

detecting a prospective drilling mode transition from the first drilling mode to a second drilling mode;

upon said detecting the prospective drilling mode transition, determining a sinusoidal buckling ratio between a minimum weight-on-bit to induce sinusoidal buckling in sliding mode and a minimum weight-on-bit to induce sinusoidal buckling in rotating mode; and determining a helical buckling ratio between a minimum weight-on-bit to induce helical buckling in sliding mode and a minimum weight-on-bit to induce helical buckling in rotating mode;

determining a weight-on-bit operating range that comprises a range of buckling ratios between the determined sinusoidal buckling ratio and helical buckling ratio; and transitioning from the first drilling mode to the second drilling mode, wherein said transitioning includes transitioning from the first weight-on-bit to a second weight-on-bit that is determined in accordance with the ratio between the second weight-on-bit and the first weight-on-bit being within the weight-on-bit operating range.

2. The method of claim 1, wherein one of the first and second drilling modes is a sliding mode and the other of the first and second drilling modes is a rotating mode.

3. The method of claim 1, further comprising:

dynamically adapting the second weight-on-bit to maximize a rate of penetration.

4. The method of claim 1, wherein the sinusoidal buckling ratio and helical buckling ratio each vary with position along a borehole.

5. The method of claim 1, wherein determining a sinusoidal buckling ration and a helical buckling ratio comprises determining a sinusoidal ratio and a helical buckling ratio for a current position of a drill bit on the drill string.

6. The method of claim 1, wherein said determining a weight-on-bit operating range further includes determining the weight-on-bit operating range based, at least in part, on the first weight-on-bit.

7. The method of claim 6, further comprising determining the first weight-on-bit dynamically for ongoing drilling operations.

8. The method of claim 1, wherein said determining a sinusoidal buckling ratio comprises determining a ratio of a minimum weight-on-bit to induce sinusoidal buckling in sliding mode to a minimum weight-on-bit to induce sinusoidal buckling in rotating mode, and wherein determining a helical buckling ratio comprises determining a ratio of a minimum weight-on-bit to induce helical buckling in sliding mode to a minimum weight-on-bit to induce helical buckling in rotating mode.

9. A drilling system that comprises:

a processor; and a machine-readable medium having program code executable by the processor to cause the drilling system to:

operate a drill string drilling operation in a first drilling mode that applies a first weight-on-bit;

detect a prospective drilling mode transition from the first drilling mode to a second drilling mode;

upon said detecting the prospective drilling mode transition, determine a sinusoidal buckling ratio between a minimum weight-on-bit to induce sinusoidal buckling in sliding mode and a minimum weight-on-bit to induce sinusoidal buckling in rotating mode; and determine a helical buckling ratio between a minimum weight-on-bit to induce helical buckling in sliding mode and a minimum weight-on-bit to induce helical buckling in rotating mode;

determine a weight-on-bit operating range that comprises a range of buckling ratios between the determined sinusoidal buckling ratio and helical buckling ratio; and transition from the first drilling mode to the second drilling mode, wherein said transitioning includes transitioning from the first weight-on-bit to a second weight-on-bit that is determined in accordance with the ratio between the second weight-on-bit and the first weight-on-bit being within the weight-on-bit operating range.

10. The drilling system of claim 9, wherein one of the first and second drilling modes is a sliding mode and the other of the first and second drilling modes is a rotating mode.

11. The drilling system of claim 9, wherein the first weight- on-bit maximizes a rate of penetration for the first drilling mode.

12. The drilling system of claim 9, wherein said determining the sinusoidal buckling ratio and the helical buckling ratio comprises determining the sinusoidal buckling ration and the helical buckling ratio for multiple points along a borehole trajectory.

13. The system of claim 9, wherein determining a sinusoidal buckling ration and a helical buckling ratio comprises determining a sinusoidal ratio and a helical buckling ratio for a current position of a drill bit on the drill string.

14. The system of claim 9, wherein said determining a weight-on-bit operating range further includes determining the weight-on-bit operating range based, at least in part, on the first weight-on-bit.

15. The system of claim 9, wherein said determining a sinusoidal buckling ratio comprises determining a ratio of a minimum weight-on-bit to induce sinusoidal buckling in sliding mode to a minimum weight-on-bit to induce sinusoidal buckling in rotating mode, and wherein determining a helical buckling ratio comprises determining a ratio of a minimum weight-on-bit to induce helical buckling in sliding mode to a minimum weight-on-bit to induce helical buckling in rotating mode.

16. A non-transitory computer readable medium comprising computer executable instructions for optimizing weight-on-bit for a drilling operation, wherein execution of the computer executable instructions causes one or more machines to perform operations comprising:

operating a drill string drilling operation in a first drilling mode that applies a first weight-on-bit;

detecting a prospective drilling mode transition from the first drilling mode to a second drilling mode;

upon said detecting the prospective drilling mode transition, determining a sinusoidal buckling ratio between a minimum weight-on-bit to induce sinusoidal buckling in sliding mode and a minimum weight-on-bit to induce sinusoidal buckling in rotating mode; and determining a helical buckling ratio between a minimum weight-on-bit to induce helical buckling in sliding mode and a minimum weight-on-bit to induce helical buckling in rotating mode;

determining a weight-on-bit operating range based, at least in part, on the determined sinusoidal buckling ratio and helical buckling ratio; and transitioning from the first drilling mode to the second drilling mode, wherein said transitioning includes transitioning from the first weight-on-bit to a second weight-on-bit that is determined in accordance with the ratio between the second weight-on-bit and the first weight-on-bit being within the weight-on-bit operating range.

17. The medium of claim 16, wherein the first weight-on-bit maximizes a rate of penetration for the first drilling mode.

18. The medium of claim 16, further comprising:

dynamically adapting the second weight-on-bit to maximize a rate of penetration.

19. The medium of claim 16, wherein said determining a weight-on-bit operating range further includes determining the weight-on-bit operating range based, at least in part, on the first weight-on-bit.

20. The medium of claim 19, further comprising determining the first weight-on-bit dynamically for ongoing drilling operations.

* * * * *